US012029258B2

(12) United States Patent
Ambelang

(10) Patent No.: US 12,029,258 B2
(45) Date of Patent: Jul. 9, 2024

(54) ARTICLE OF APPAREL

(71) Applicant: Bryce Ambelang, Addison, TX (US)

(72) Inventor: Bryce Ambelang, Addison, TX (US)

(73) Assignee: Bryce Ambelang, Addison, TX (US)

( * ) Notice: Subject to any disclaimer, the term of this patent is extended or adjusted under 35 U.S.C. 154(b) by 0 days.

(21) Appl. No.: 17/174,114

(22) Filed: Feb. 11, 2021

(65) Prior Publication Data

US 2022/0248773 A1 Aug. 11, 2022

(51) Int. Cl.

*A41B 1/06* (2006.01)
*A41B 9/00* (2006.01)
*A41D 1/06* (2006.01)

(52) U.S. Cl.

CPC ..... *A41B 1/06* (2013.01); *A41B 9/001* (2013.01); *A41D 1/06* (2013.01); *A41B 2300/322* (2013.01); *A41B 2300/324* (2013.01); *A41D 2300/322* (2013.01); *A41D 2300/324* (2013.01)

(58) Field of Classification Search

CPC .. A41B 1/06; A41B 9/08; A41B 9/008; A41F 5/00; A41F 17/00
USPC ..... 2/107, 117, 70
See application file for complete search history.

(56) References Cited

U.S. PATENT DOCUMENTS 959,611 A * 5/1910 Rosen ..... A41F 5/00 2/117
1,975,285 A 10/1934 Pearse
2,104,487 A 1/1938 Kessler
2,109,867 A * 3/1938 Pedlar ..... A41D 1/22 2/73
2,130,690 A * 9/1938 Lemoine ..... A41D 13/02 2/70
2,142,479 A 1/1939 Rosenfelder
2,164,281 A 6/1939 McDonald
2,164,683 A 7/1939 Kessler
2,269,120 A 1/1942 McCarthy
2,274,382 A * 2/1942 Richman ..... A41C 3/08 2/73
2,319,138 A 5/1943 Kneibler
2,559,953 A * 7/1951 Evans ..... A41D 1/00 D2/757
2,562,234 A 7/1951 Gottschalk
(Continued)

FOREIGN PATENT DOCUMENTS

CA 2545122 A1 9/2005
CN 303598853 3/2016
(Continued)

OTHER PUBLICATIONS

Iiniim Men's Long Sleeve Zipper Front Romper Shirt One-Piece Bowtie Leotard Bodysuit, announced Oct. 8, 2018 [online], [site visited Dec. 16, 2022]. Available from internet, URL: <https://www.amazon.com/iiniim-Sleeve-One-Piece-Leotard-Bodysuit/dp/B07D3SGK2S/?th=1> (Year: 2018).
(Continued)

*Primary Examiner* — Katherine M Moran
*Assistant Examiner* — Grady Alexander Nunnery
(74) *Attorney, Agent, or Firm* — Banner & Witcoff, Ltd.

(57) ABSTRACT

Aspects described herein generally relate to articles of apparel having an upper body garment, a lower body garment, and an engagement device configured to removably engage the upper body portion and the lower body portion. The engagement device may comprise a continuous zipper.

17 Claims, 12 Drawing Sheets

(56) References Cited

U.S. PATENT DOCUMENTS

| | | | | |
|---|---|---|---|---|
| 2,636,287 | A | 4/1953 | Heilbronner | |
| 2,849,716 | A * | 9/1958 | Kerson | A41D 15/00 2/70 |
| D214,011 | S | 5/1969 | Johnson | |
| 4,077,066 | A | 3/1978 | Weiss | |
| 4,805,243 | A | 2/1989 | Gibbens et al. | |
| 5,210,882 | A | 5/1993 | Moretz et al. | |
| 5,568,779 | A | 10/1996 | Wong | |
| 5,689,836 | A | 11/1997 | Fee et al. | |
| 5,802,612 | A | 9/1998 | Hosking | |
| 6,074,274 | A | 6/2000 | Pyatt | |
| D431,345 | S | 10/2000 | Newkirk, Jr. | |
| 6,185,745 | B1 | 2/2001 | Alger | |
| 6,223,352 | B1 * | 5/2001 | Watlington | A41D 15/002 2/83 |
| 6,234,117 | B1 | 5/2001 | Spatt | |
| 6,349,413 | B1 | 2/2002 | Rose et al. | |
| 6,401,250 | B1 | 6/2002 | McNabb | |
| 6,848,121 | B1 | 2/2005 | Halid | |
| D553,826 | S | 10/2007 | Austin | |
| D635,335 | S | 4/2011 | Eckman et al. | |
| 7,962,969 | B1 | 6/2011 | Blakely | |
| 7,992,222 | B1 | 8/2011 | Behrens | |
| D687,617 | S | 8/2013 | LaCour-Phillippi | |
| D702,018 | S | 4/2014 | Ferraro | |
| D735,444 | S | 8/2015 | Harris | |
| D756,069 | S | 5/2016 | Astin | |
| D759,345 | S | 6/2016 | Astin | |
| D783,235 | S | 4/2017 | Hakim et al. | |
| D783,938 | S | 4/2017 | Todd | |
| D794,904 | S | 8/2017 | Johnston | |
| 9,750,285 | B2 | 9/2017 | Davis | |
| D798,530 | S | 10/2017 | Cook | |
| D834,288 | S | 11/2018 | Koh | |
| D848,110 | S | 5/2019 | Harris | |
| D853,684 | S | 7/2019 | Gillen | |
| D864,523 | S | 10/2019 | Diamond | |
| 10,542,782 | B2 | 1/2020 | Shupe et al. | |
| D882,211 | S | 4/2020 | Lines | |
| D886,412 | S | 6/2020 | Harris | |
| D893,831 | S | 8/2020 | Perry | |
| 10,834,974 | B2 | 11/2020 | Bigney | |
| 10,888,470 | B2 | 1/2021 | Riha-Scott | |
| D913,632 | S | 3/2021 | Franco et al. | |
| D916,429 | S | 4/2021 | Tanenbaum | |
| 10,986,877 | B2 | 4/2021 | Kimel | |
| D922,730 | S | 6/2021 | Bae | |
| 11,234,467 | B1 | 2/2022 | Olsgard et al. | |
| D946,237 | S | 3/2022 | Calamia | |
| D946,865 | S | 3/2022 | Calamia | |
| D953,694 | S | 6/2022 | Zhang | |
| D959,792 | S | 8/2022 | Bae | |
| D963,990 | S | 9/2022 | Bae | |
| D963,991 | S | 9/2022 | Bae | |
| D973,310 | S | 12/2022 | Palanacki | |
| 11,553,737 | B1 | 1/2023 | Hong | |
| D987,936 | S | 6/2023 | Bush et al. | |
| D988,640 | S | 6/2023 | Ambelang | |
| D996,775 | S | 8/2023 | Gerosa | |
| D998,284 | S | 9/2023 | McCassy | |
| 2006/0010559 | A1 | 1/2006 | Hamlet | |
| 2009/0192433 | A1 * | 7/2009 | Wells | A41D 13/1245 602/77 |
| 2012/0071849 | A1 | 3/2012 | Kumar | |
| 2012/0167279 | A1 | 7/2012 | Bigney | |
| 2013/0283494 | A1 | 10/2013 | Vaughn | |
| 2015/0026870 | A1 | 1/2015 | Flemma | |
| 2015/0026990 | A1 * | 1/2015 | Ellis | A41H 1/00 33/15 |
| 2015/0290049 | A1 | 10/2015 | Riha-Scott | |
| 2016/0135509 | A1 | 5/2016 | Clement | |
| 2016/0324238 | A1 | 11/2016 | Tran | |
| 2017/0196283 | A1 * | 7/2017 | Hart | A41D 15/00 |
| 2017/0325519 | A1 * | 11/2017 | Willingham | A41D 7/00 |
| 2017/0325530 | A1 * | 11/2017 | Etheridge | D06B 11/0096 |
| 2018/0310633 | A1 | 11/2018 | Harris | |
| 2019/0116889 | A1 | 4/2019 | Kimel | |
| 2019/0320731 | A1 * | 10/2019 | Singh | A41B 9/08 |
| 2019/0387809 | A1 | 12/2019 | Perry et al. | |
| 2020/0221802 | A1 * | 7/2020 | They | A41D 1/06 |
| 2022/0000201 | A1 | 1/2022 | Torano et al. | |
| 2022/0248773 | A1 | 8/2022 | Ambelang | |
| 2022/0346461 | A1 | 11/2022 | Wittrock | |
| 2022/0408847 | A1 | 12/2022 | Mendoza | |
| 2023/0218017 | A1 | 7/2023 | Harrison | |

FOREIGN PATENT DOCUMENTS

| | | | | |
|---|---|---|---|---|
| CN | 307313595 | | 5/2022 | |
| EP | 008285399-0001 | | 11/2020 | |
| FR | 2559652 | A1 | 8/1985 | |
| GB | 469135 | A * | 7/1937 | A41D 15/00 |
| GB | 6191817 | | 2/2022 | |
| JP | D1468076 | | 5/2013 | |
| JP | D1720990 | | 7/2022 | |
| KR | 301093764 | | 2/2021 | |

OTHER PUBLICATIONS

Zip Tech® | Volcom Outerwear, announced Oct. 12, 2018 [online], [site visited Jan. 6, 2023]. Available from internet. URL: <https://www.youtube.com/watch?v=izmOZN7iazU> (Year: 2018).

Tommy John Presents: Tuck Hacks// Underwear Tuck, announced Sep. 28, 2018 [online], [site visited Jan. 5, 2023]. Available from internet, URL: <https://www.youtube.com/watch?v=zQ-xXkuDchQ> (Year: 2018).

Bambelang Shirt, announced Sep. 14, 2020 [online], [site visited Jan. 5, 2023]. Available from internet, URL: <https://www.instagram.com/p/CFljmjnhlSA/?utm_source=ig_web_button_share_sheet> (Year: 2020).

2 Packs Men's Boxer Briefs Secret Hidden Pocket, First available: Nov. 7, 2020 [online], [visited: Sep. 21, 2022] Available from the internet URL: https://www.amazon.com/dp/B08MXNYY36?ref_=cm_sw_r_cp_ud_dp_NARSWDWQPCY05G1ASN0K&th=1 (Year: 2020).

Stance Men's Staple Underwear, First available: Oct. 26, 2020 [online], [visited: Sep. 21, 2022], Available from the internet URL: https://www.amazon.com/dp/B0142K6F70?ref_=cm_sw_r_cp_ud_dp_ 9HT7HHDMPH42MH N1B0K7&th=1 (Year: 2020).

Eberjey Gisele Classic Women's Pajama Set, First available: Jan. 29, 2019 [online], [visited: Oct. 13, 2022] Available from the internet URL: https://www.amazon.com/dp/B077T583TR?ref_=cm_sw_r_cp_ud_dp_C8YSQ6XSC7JDE5N44TB8&th=1 (Year: 2019).

KICKEE Women's Solid Long Sleeve Collared Pajama Top with Shorts, First available: Nov. 16, 2021 [online], [visited: Oct. 13, 2022] Available from the internet URL: https://www.amazon.com/dp/B09MZ48NM7?ref_=cm_sw_r_cp_ud_dp_G58WPGKW3MKP3PT77FJ8+2%2F3&th=1 (Year: 2021).

Anthem Athletics Hyperflex Workout Shorts, First available: Jul. 16, 2020 [online], [visited: Apr. 4, 2023] Available from the internet URL: https://www.amazon.com/dp/B07TMNJLV8?ref_=cm_sw_r_cp_ud_dp_DYZZMQD4HK9QA1POCPXP (Year: 2020).

Ekouaer Womens 2 Piece Satin Pajama Set, First available: Jan. 13, 2023 [online], [visited: Apr. 4, 2023] Available from the internet URL: https://www.amazon.com/dp/BOBS8VNJVT?ref_=cm_sw_r_cp_ud_dp_G6DRA6K1KBHPN5MDGCG3 (Year: 2023).

Luexbox 4 Packs Pocket Underwear, First available: Jan. 16, 2019 [online], [visited: Sep. 12, 2023] Available from the internet URL: https://www.amazon.com/dp/BOB6H PDXSZ ?_ encoding=UTF8&ref_=cm_sw_r_cp_ud_dp_KW963DM2ZMPVCZS728P6&th=1&psc=1 (Year: 2019).

* cited by examiner

ARTICLE OF APPAREL

FIELD

Aspects described herein generally relate to articles of apparel, including upper body garments such as shirts and undershirts and lower body garments such as shorts, pants, and underwear, in particular an article of apparel having an upper body garment removably engageable with a lower body garment.

BACKGROUND

Articles of apparel exist for all types of activities. These types of apparel can include outer wear, active wear, casual wear and tailored clothing. Apparel often includes an upper body garment and a lower body garment. However, the upper body garments and lower body garments can often appear unkempt or disheveled.

BRIEF SUMMARY

In light of the foregoing background, the following presents a simplified summary of the present disclosure in order to provide a basic understanding of some aspects of the various implementations of this disclosure. This summary is not an extensive overview of the embodiments described herein. It is not intended to identify key or critical elements, or to delineate the scope of the embodiments described in this disclosure. The following summary merely presents some concepts of the embodiments of this disclosure in a simplified form as a prelude to the more detailed description provided below.

Aspects of this disclosure may relate to an article of apparel. The article of apparel can include an upper an upper body garment such as a shirt, the upper body garment including a top end, a bottom end, a first arm hole and second arm hole, a front side and a back side, an interior side and an exterior side, the upper body garment also having a chest circumference "C", upper engagement circumference "UEC", and a bottom circumference "B". The article of apparel can also a lower body garment such as underwear, the lower body garment having a top end, including a waistband, and a lower end having a first leg hole and a second leg hole, a front side, a back side, and interior side, and an exterior side, the lower body garment also having a lower engagement circumference "LEC".

The article of apparel can also include an engagement device configured to removably engage the upper body garment and the lower body garment, the engagement device having a first end and a second end, the engagement device also having an engagement device upper portion engaged with the interior side of the upper body garment at the upper engagement circumference "UEC", the engagement device upper portion having an engagement device upper portion length, and the engagement device having an engagement device lower portion engaged with the exterior side of the lower body garment at the lower engagement circumference "LEC", the engagement device lower portion have an engagement device lower portion length.

The upper body garment can be tapered such that the upper engagement circumference "UEC" is less than both the chest circumference "C" and the bottom circumference "B". The upper engagement circumference "UEC" can be substantially similar to the lower engagement circumference "LEC". The ratio of the length of engagement device upper portion "LU" to the upper engagement circumference "UEC" (LU/UEC) is in the range of 0.45:1 to 0.95:1; and the ratio of the length of engagement device lower portion "LL" to the lower engagement circumference "LEC" (LU/UEC) is in the range of 0.45:1 to 0.95:1. The engagement device can be a zipper, such as a continuous zipper, and the engagement device can be engaged with the upper body garment and the lower body garment in a substantially vertically level arrangement.

The engagement device can be divided into a plurality of separate sections. In some embodiments, the engagement device can be divided into two separate sections.

The engagement device upper portion can be stitched the upper body garment; and the engagement device lower portion can be stitched the lower body garment.

In some embodiments, the engagement device can be removably engaged with each of the upper body garment and the lower body garment. The engagement device upper portion can be removably attached to the upper body garment using one of hook and loop fasteners, buttons, snaps, or magnets; and the engagement device lower portion can be removably attached to the lower body garment using one of hook and loop fasteners, buttons, snaps, or magnets.

In some embodiments, the upper body garment comprises a shirt and the lower body garment comprises underwear. And in some embodiments, the upper body garment comprises an athletic jersey.

Still other aspects of this disclosure may relate to an article of apparel. The article of apparel can include an upper an upper body garment such as a shirt, the upper body garment including a top end, a bottom end, a first arm hole and second arm hole, a front side and a back side, an interior side and an exterior side, the upper body garment also having a chest circumference "C", upper engagement circumference "UEC", and a bottom circumference "B". The article of apparel can also a lower body garment such as underwear, the lower body garment having a top end, including a waistband, and a lower end having a first leg hole and a second leg hole, a front side, a back side, and interior side, and an exterior side, the lower body garment also having a lower engagement circumference "LEC".

The article of apparel can also include an engagement device configured to removably engage the upper body garment and the lower body garment, the engagement device having a first end and a second end, the engagement device also having an engagement device upper portion engaged with the interior side of the upper body garment at the upper engagement circumference "UEC", the engagement device upper portion having an engagement device upper portion length, and the engagement device having an engagement device lower portion engaged with the exterior side of the lower body garment at the lower engagement circumference "LEC", the engagement device lower portion have an engagement device lower portion length.

The upper body garment can be tapered such that the upper engagement circumference "UEC" is less than both the chest circumference "C" and the bottom circumference "B". The ratio of the length of engagement device upper portion "LU" to the upper engagement circumference "UEC" (LU/UEC) can be in the range of 0.70:1 to 0.85:1; and the ratio of the length of engagement device lower portion "LL" to the lower engagement circumference "LEC" (LU/UEC) can be in the range of 0.70:1 to 0.85:1.

The ratio of the chest circumference "C" to upper engagement circumference "UEC" (C:UEC) can be in the range of in the range of about 1.2:1 to 1.01:1.

In some embodiments, the upper engagement circumference "UEC" can be substantially similar to the lower engagement circumference "LEC". In some embodiments, the upper engagement circumference "UEC" can be greater than the lower engagement circumference "LEC". And in some embodiments, the upper engagement circumference "UEC" is less than the lower engagement circumference "LEC".

Still other aspects of this disclosure may relate to an article of apparel. The article of apparel can include an upper an upper body garment such as a shirt, the upper body garment including a top end, a bottom end, a first arm hole and second arm hole, a front side and a back side, an interior side and an exterior side, the upper body garment also having a chest circumference "C", upper engagement circumference "UEC", and a bottom circumference "B". The article of apparel can also a lower body garment such as underwear, the lower body garment having a top end, including a waistband, and a lower end having a first leg hole and a second leg hole, a front side, a back side, and interior side, and an exterior side, the lower body garment also having a lower engagement circumference "LEC".

The article of apparel can also include an engagement device configured to removably engage the upper body garment and the lower body garment, the engagement device having a first end and a second end, the engagement device also having an engagement device upper portion engaged with the interior side of the upper body garment at the upper engagement circumference "UEC", the engagement device upper portion having an engagement device upper portion length, and the engagement device having an engagement device lower portion engaged with the exterior side of the lower body garment at the lower engagement circumference "LEC", the engagement device lower portion have an engagement device lower portion length.

The ratio of the length of engagement device upper portion "LU" to the upper engagement circumference "UEC" (LU/UEC) can be in the range of 0.45:1 to 0.95:1; and the ratio of the length of engagement device lower portion "LL" to the lower engagement circumference "LEC" (LU/UEC) can be in the range of 0.45:1 to 0.95:1.

The engagement device can comprise a zipper; and the engagement device can be engaged with the upper body garment and the lower body garment in a substantially vertically level arrangement; and the engagement device lower portion can be engaged with the lower body garment below the waistband.

The engagement device lower portion can be engaged with the lower body garment in a range of about 0 inches to 9 inches below the waistband. In some embodiments, the engagement device lower portion can be engaged with the lower body garment in a range of about 1 inch to 7 inches below the waistband.

The engagement device can be divided into a plurality of separate sections.

The ratio of the length of engagement device upper portion "LU" to the upper engagement circumference "UEC" (LU/UEC) can be in the range of 0.70:1 to 0.85:1; and the ratio of the length of engagement device lower portion "LL" to the lower engagement circumference "LEC" (LU/UEC) can be in the range of 0.70:1 to 0.85:1.

The ratio of the length of engagement device upper portion "LU" to the upper engagement circumference "UEC" (LU/UEC) can be in the range of 0.50:1 to 0.90:1; and the ratio of the length of engagement device lower portion "LL" to the lower engagement circumference "LEC" (LU/UEC) can be in the range of 0.50:1 to 0.90:1.

BRIEF DESCRIPTION OF THE DRAWINGS

The present disclosure is illustrated by way of example and not limited in the accompanying figures in which like reference numerals indicate similar elements and in which.

DETAILED DESCRIPTION

Figure 1:
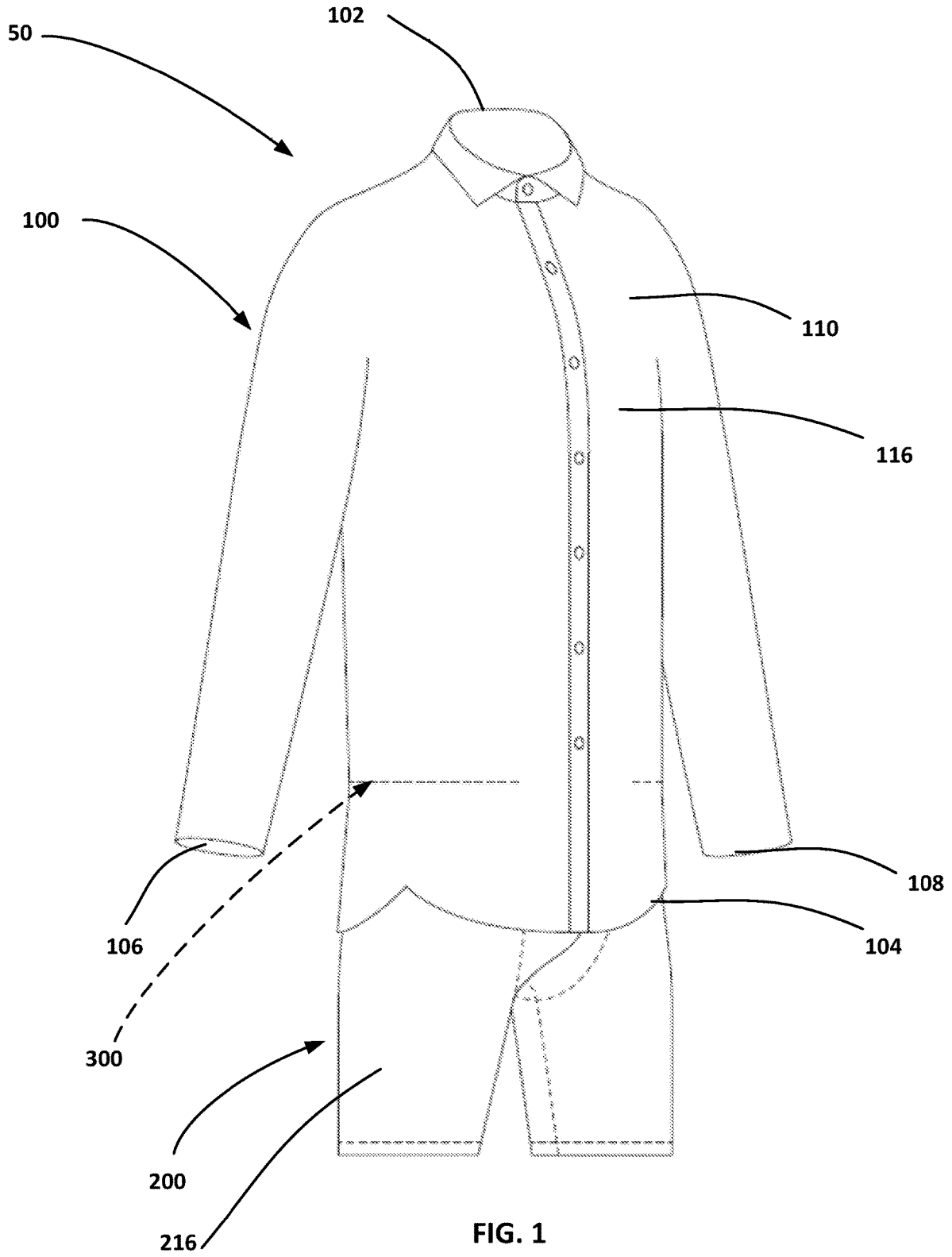
FIG. 1 illustrates a perspective view of an article of apparel including an upper body garment and a lower body garment combination, according to one or more aspects described herein.

In the following description of various example structures, reference is made to the accompanying drawings, which form a part hereof, and in which are shown by way of illustration various example cleaning implements, wringers, and connection assemblies in accordance with various embodiments Additionally, it is to be understood that other specific arrangements of parts and structures may be utilized and structural and functional modifications may be made without departing from the scope of this disclosure. Also, while the terms "upper," "lower," "front," "back," "rear," "top," "bottom," and the like may be used in this specification to describe various example features and elements, these terms are used herein as a matter of convenience, e.g., based on the example orientations shown in the figures and/or the orientations in typical use.

FIGS. 1-11 illustrate various views of an example article of apparel 50, according to one or more aspects described herein. The exemplary article of apparel 50 may comprise an upper body garment 100 and a lower body garment 200. The upper body garment 100 and the lower body garment may be removably engaged through an engagement device 300. The engagement device 300 can removably engage the upper body garment 100 to the lower body garment. The engagement device 300 can include portions which are located on an inner surface of the upper body garment 100 and an outer surface of the lower body garment 200. The location of the engagement device 300 is shown by a dotted line in FIG. 1.

As best shown in FIGS. 1-3 and 5A-5B, the upper body garment 100 can be a shirt, such as a dress shirt, or any other type of upper body garment including, for example, a t-shirt or athletic jersey. The upper body garment 100 includes a top end 102, a bottom end 104, a first arm hole 106 and second arm hole 108. The upper body garment also includes a front side 110 and a back side 112, and an interior side 114 and an exterior side 116. The upper body garment 100 can be made of any suitable material including for example cotton, polyester, nylon, linen, lycra, rayon, and any type of fabric blends.

Figure 4:
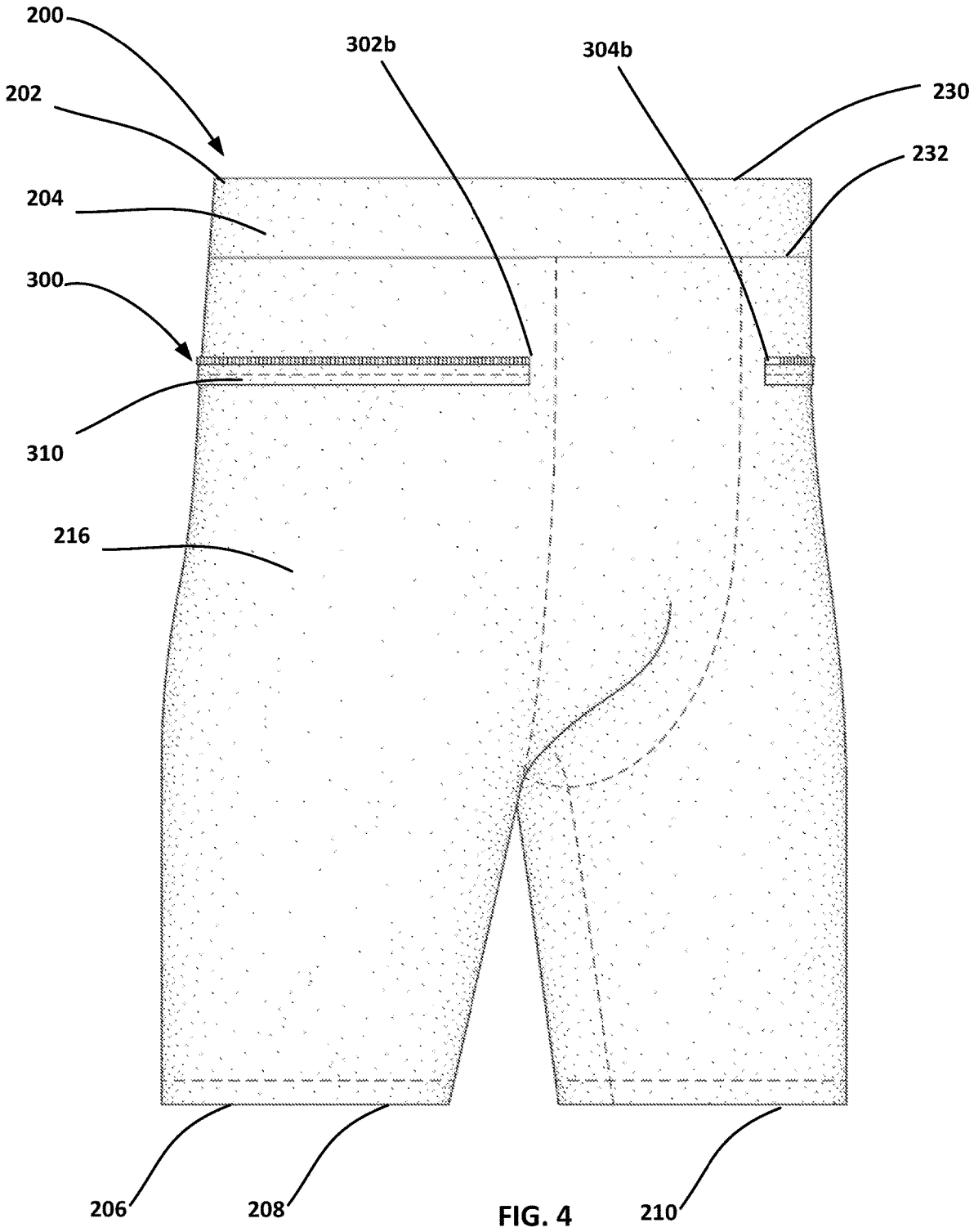
FIG. 4 illustrates a perspective view of the lower body garment of FIG. 1, according to one or more aspects described herein.
Figure 9:
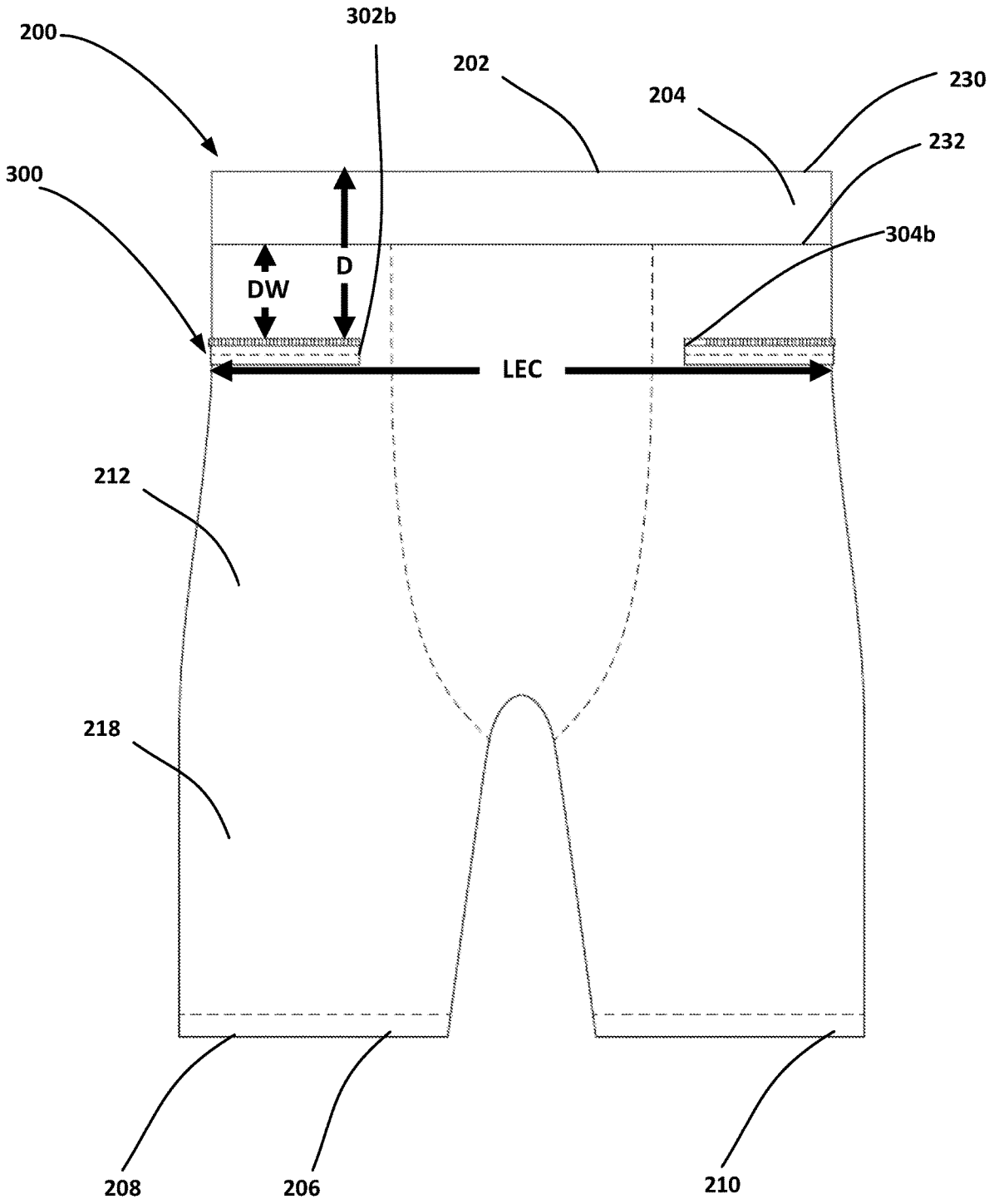
FIG. 9 illustrates a front view of the lower body garment of FIG. 1, according to one or more aspects described herein.
Figure 10:
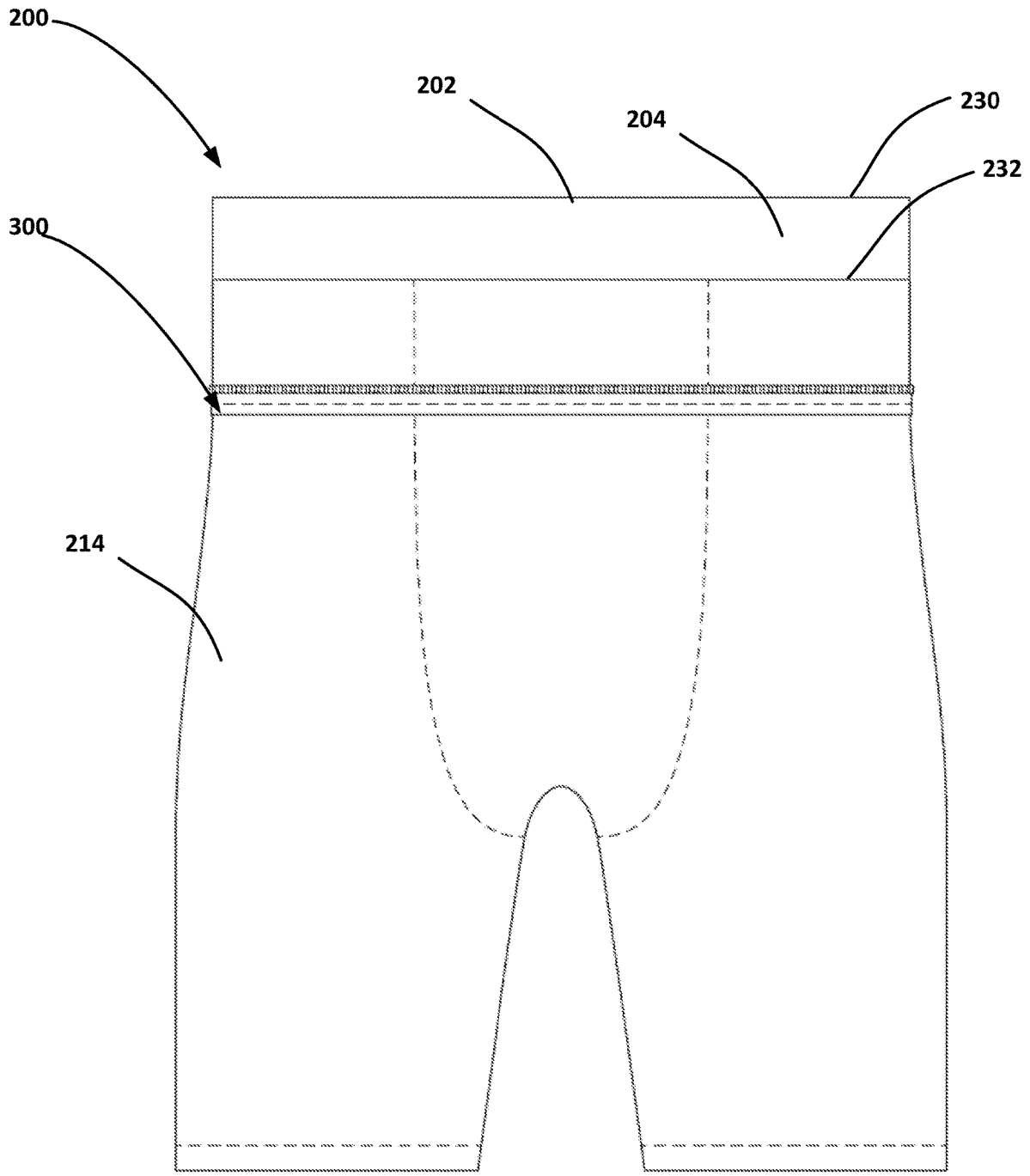
FIG. 10 illustrates a back view of the lower body garment of FIG. 1, according to one or more aspects described herein.
Figure 11A:
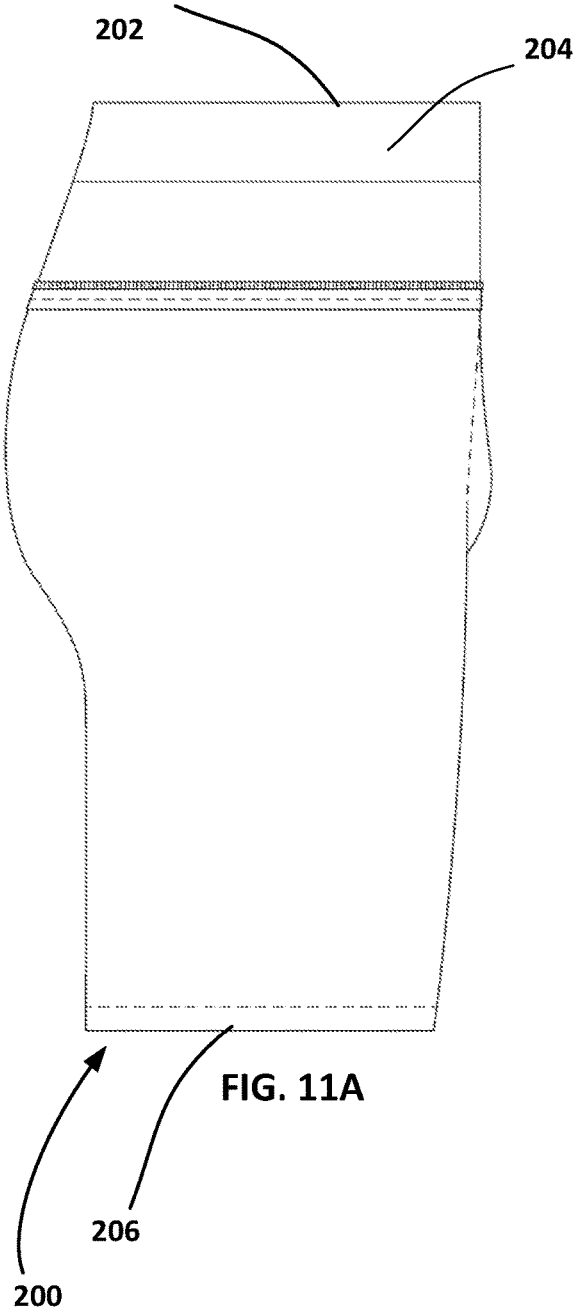
FIG. 11A illustrates a right side view of the lower body garment of FIG. 1, according to one or more aspects described herein.
Figure 11B:
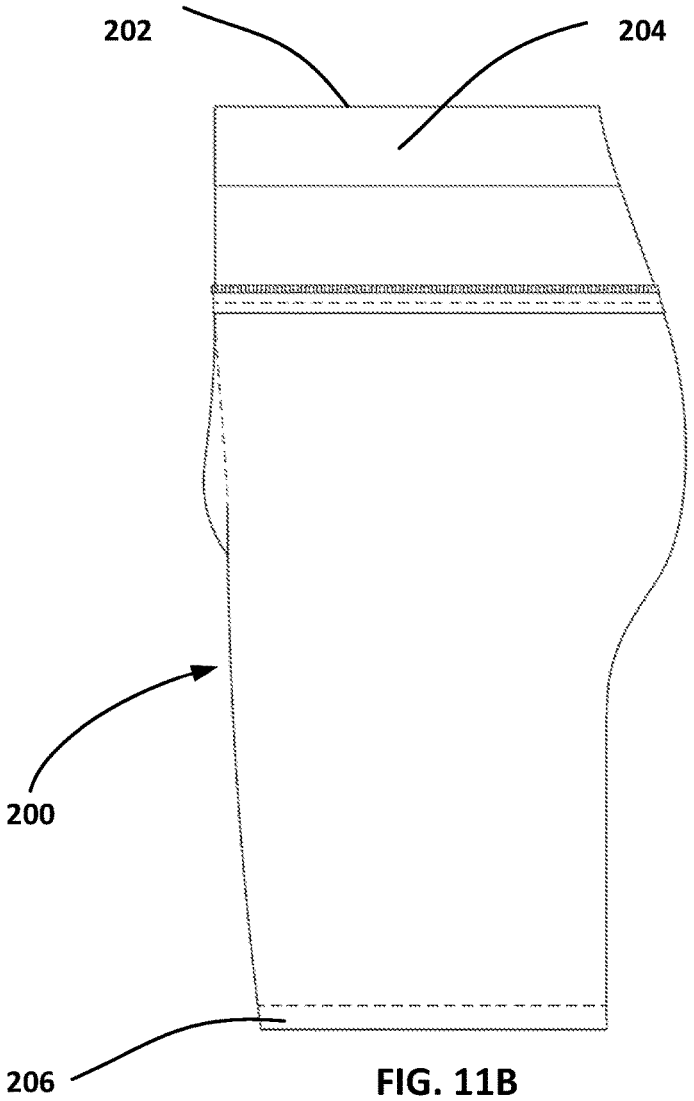
FIG. 11B illustrates a left side view of the lower body garment of FIG. 1, according to one or more aspects described herein.

The article of apparel 50 also includes a lower body garment 200 which is best shown in FIGS. 2, 4, and 9-11B. As shown in these FIGS. 2, 4, and 9-11B, the lower body garment 200 can be an under garment such as underwear designed to be worn under additional clothing. However, in other embodiments the lower body garment 200 can be pants, shorts, or other outerwear. As shown in these FIGS. 2, 4, and 9-11B, the lower body garment includes a top 202 end including a waistband 204 and a lower end 206 having a first leg hole 208 and a second leg hole 210. The lower body garment 200 also includes a front side 212, a back side 214, and an interior side 216, and an exterior side 218. As shown in FIGS. 4, 9, and 10, the waistband 204 has a top edge 230 and the waistband 204 has a bottom edge 232. As shown in FIGS. 4, 9, and 10, the waistband 204 comprises a single continuous band encircling the entire lower body garment 200. The lower body garment 200 can be made of any suitable material including for example cotton, polyester, nylon, linen, lycra, rayon, and any type of fabric blends.

As described above, the article of apparel 50 also includes an engagement device 300 configured to removably engage the upper body garment 100 to the lower body garment 200. As shown, the upper body garment 100 and the lower body garment 200 can be engaged as a single garment (FIGS. 1 and 2) and can be fully separated from each other (FIGS. 3 and 4). The engagement device 300 has a first end 302 and a second end 304 and an engagement device length defined between the first end 302 and the second end 304. The engagement device 300 also has an upper portion 306. As best shown in FIG. 3, the upper portion 306 is engaged with the interior side 114 of the upper body garment 100. The engagement device upper portion 306 has an engagement device upper portion length defined between the first end 302*a* and the second end 304*a*. The engagement device 300 also includes a lower portion 310. As best shown in FIG. 4, the engagement device lower portion 310 is engaged with the exterior side 216 of the lower body garment 200. The engagement device lower portion has an engagement device lower portion length defined between the first end 302*b* and the second end 304*b*.

Figure 2:
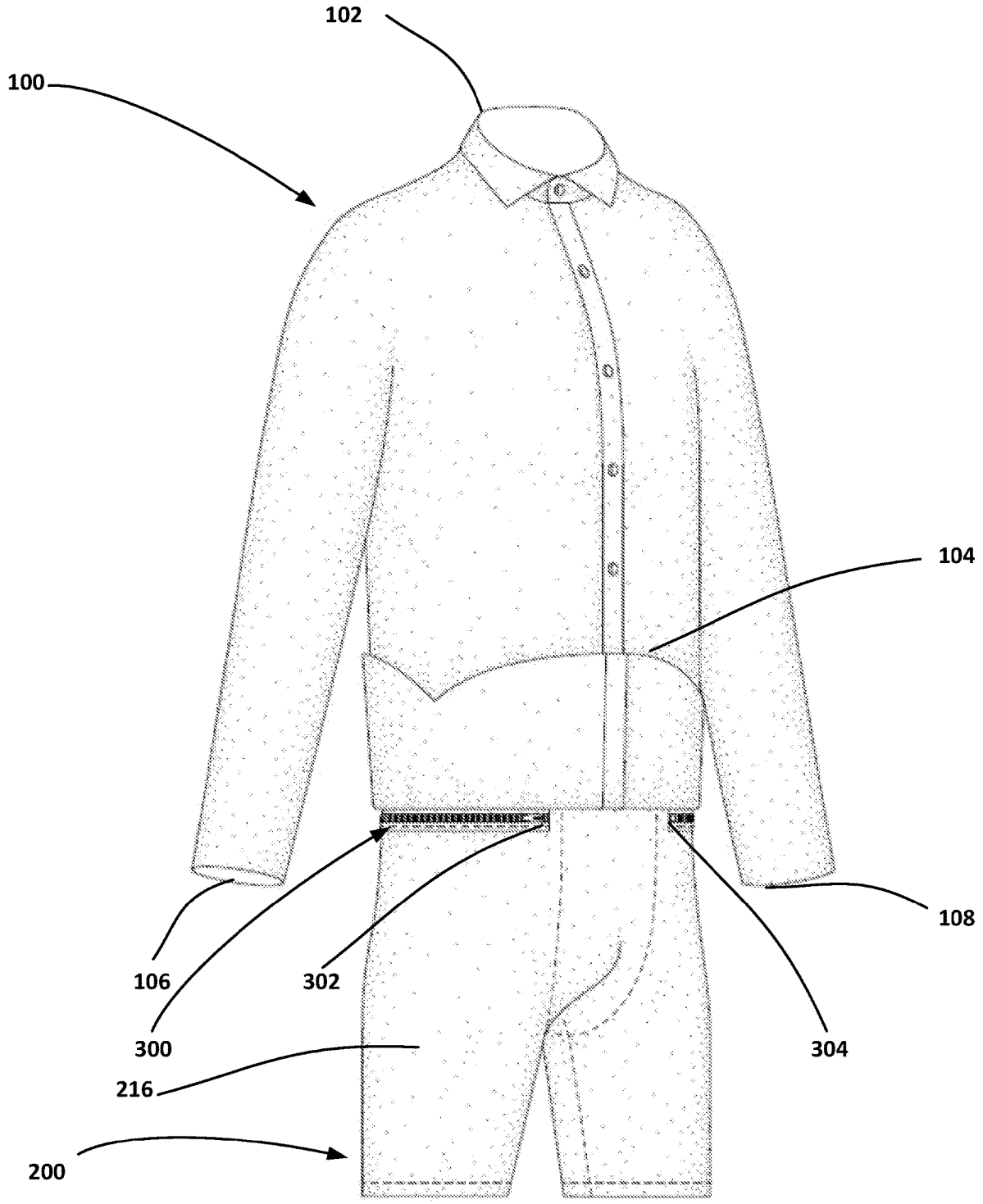
FIG. 2 illustrates a perspective view of the upper body garment and lower body garment combination of FIG. 1 with a bottom portion of the upper body garment folded upward, according to one or more aspects described herein.
Figure 3:
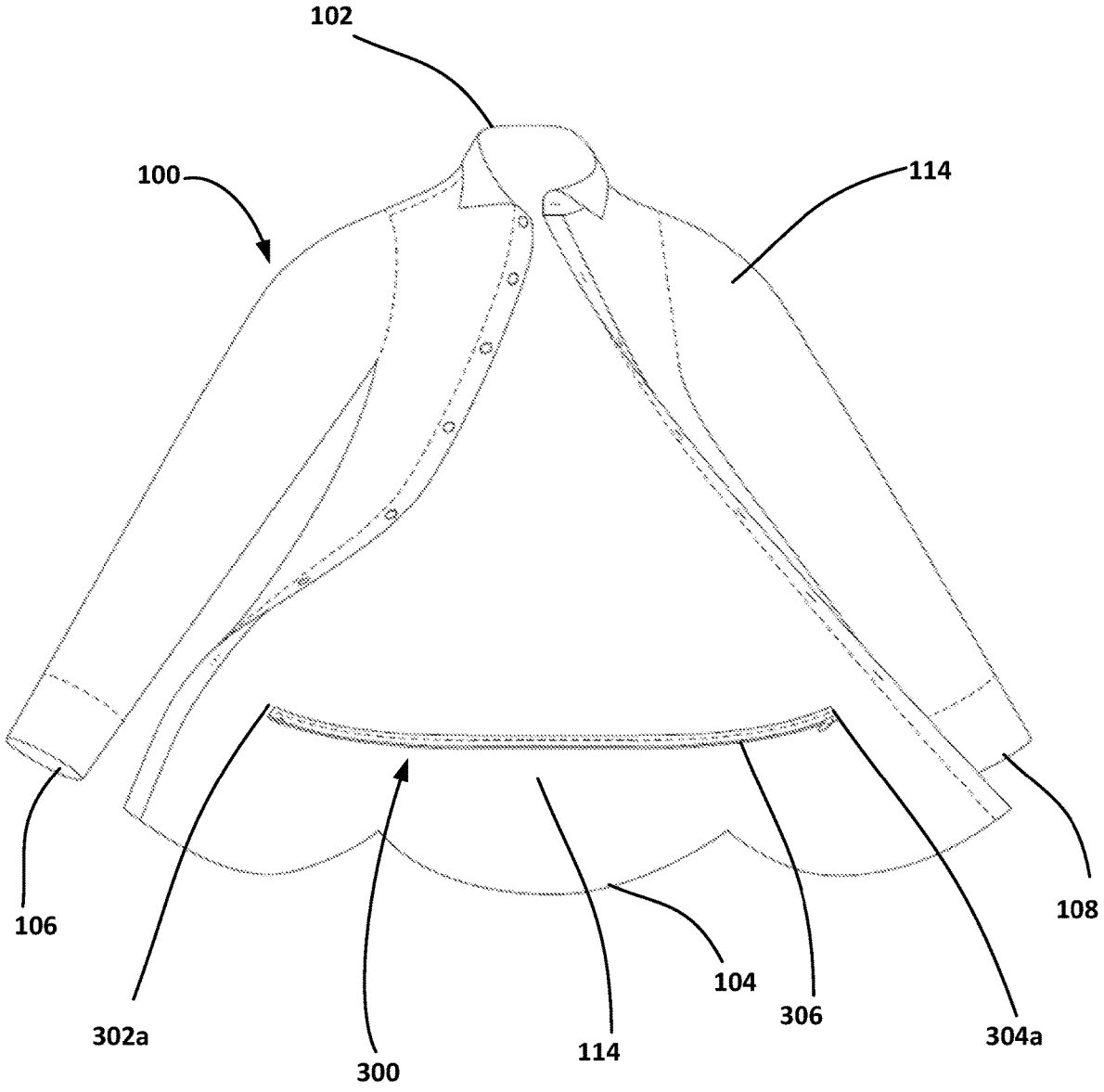
FIG. 3 illustrates a front view with portions of the upper body garment opened to show an interior portion of the upper body garment of FIG. 1, according to one or more aspects described herein.

As best shown in FIGS. 2-4, the engagement device 300 can be a continuous zipper where the upper portion 306 is non-removably attached to the upper body garment 100 and the lower portion 310 is non-removably attached to the lower body garment 200. In other embodiments, however, the engagement device 300 can have other configurations. For example, in some embodiments the engagement device 300 can comprise a discontinuous engagement system or a plurality of separate engagement device sections. For example, in some embodiments, the engagement device 300 can comprise a first engagement device primarily on a right side of the upper and lower body garments 100, 200 and a second engagement device primarily on a left side of the upper and lower body garments 100, 200.

As shown in FIGS. 2-4, the engagement device upper portion 306 is non-removably attached to the upper body garment 100 and the engagement device lower portion 310 is non-removably attached to the lower body garment 200. For example, in the embodiments shown in FIGS. 2-4, the engagement device upper portion 306 is stitched to the upper body garment 100 using thread and the engagement device lower portion 310 is stitched to the lower body garment 200 using thread. However, in other embodiments, one or both of the engagement device upper portion 306 and the engagement device lower portion 310 may be removably attached to the upper body garment 100 and/or the lower body garment 200 respectively. For example, the engagement device upper portion 306 can be removably attached to the upper body garment 100 using one of hook and loop fasteners, buttons, snaps, or magnets. Similarly, the engagement device lower body portion 310 can be removably attached to the lower body garment using one of hook and loop fasteners, buttons, snaps, or magnets. In some embodiments, one of the engagement device upper body portion 306 or the engagement device lower body portion 310 could be removably attached to the respective garment while the other is non-removably attached to the respective garment or they could both be removably attached to the respective garment portion.

As best shown in FIGS. 2-4 the engagement device comprises a continuous zipper. However, in other embodiments other engagement device 300 could be used including, for example, hook and loop fasteners, buttons, snaps, or magnets. In still other embodiments, a combination of different engagement devices could be used including any combination of hook and loop fasteners, buttons, snaps, or magnets.

As best shown in FIGS. 2-4, the engagement device 300 is shown in a substantially vertically level arrangement such that it is substantially parallel to the waistband 204. However, in other embodiments, the engagement device 300 may be vertically curved. For example, the engagement device 300 can be configured to be curved upward or downward at a user's hip area. Similarly, in other embodiments, the engagement device 300 can be configured to be curved upward or downward at a user's back area. As best shown in FIGS. 4, 9, 10, 11A, and 11B, the engagement device lower portion 310 can be located entirely below the waistband 204.

Figure 5A:
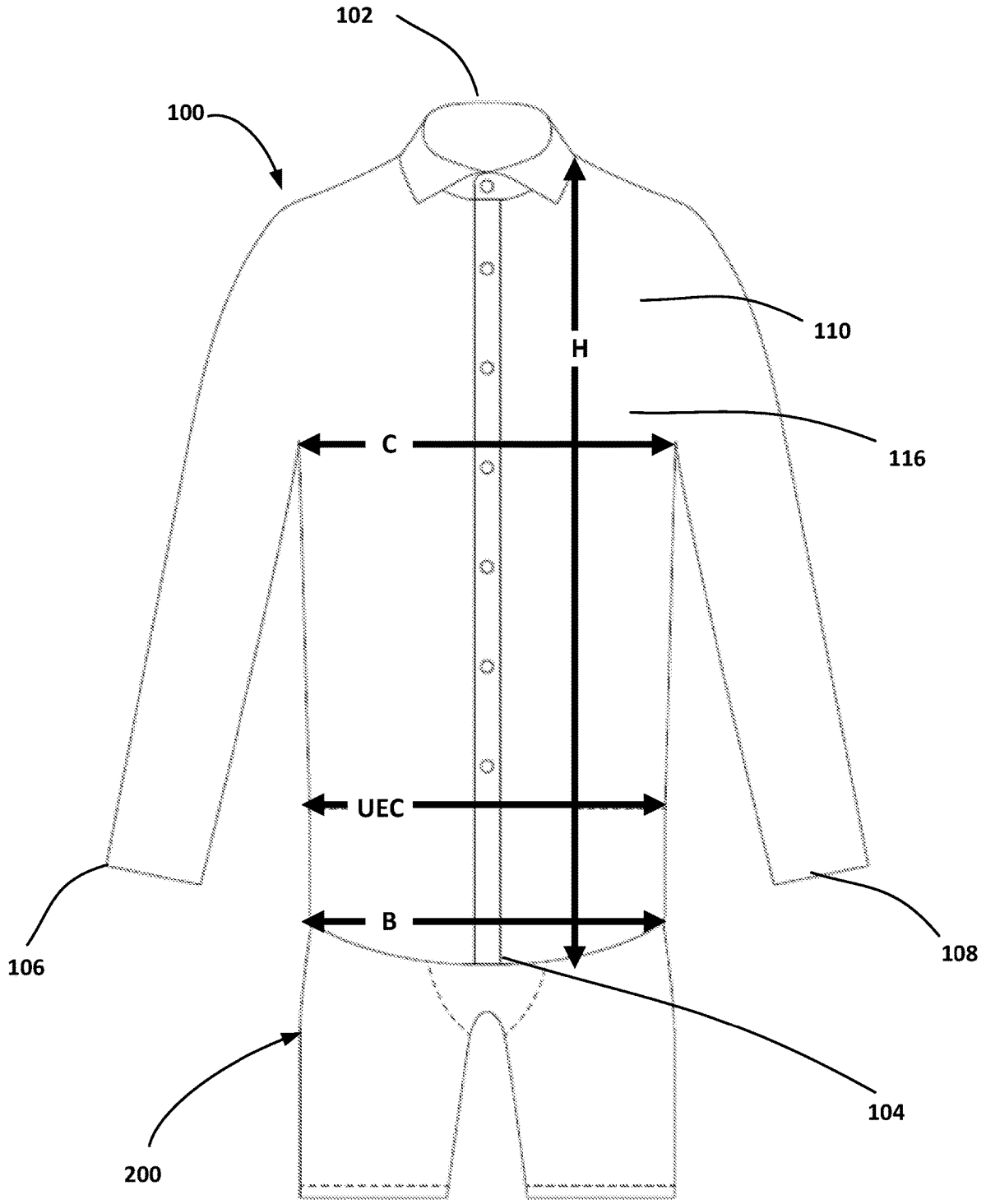
FIG. 5A illustrates a front view of an upper body garment and lower body garment combination of FIG. 1, according to one or more aspects described herein.

The upper body garment 100 can be described using various measurements and a depiction of some of these measurements is shown in FIG. 5A. These measurements include a chest circumference "C" measured around the upper body garment 100 as shown at location "C" in FIG. 5A; and a bottom circumference "B" measured around the upper body garment 100 at its bottom as shown in FIG. 5A. Additionally, as shown in FIG. 5A the upper body garment 100 can include a length "H" measured as shown at location "H" in FIG. 5A. As shown in FIG. 5A the upper body garment 100 can also include an upper engagement circumference "UEC" which is the circumference of the upper body garment 100 at the location where the engagement device upper portion 306 engages with the upper body garment 100. As will be described in greater detail below certain measurements or ratios of measurements can be advantageous to the overall functionality of the combined article of apparel 50.

Similarly, the lower body garment 200 can be described using various measurements and a depiction of some of these measurements is shown in FIG. 9. As shown in FIG. 9 the lower body garment 200 can also include a lower engagement circumference "LEC" which is the circumference of the lower body garment 200 at the location where the engagement device lower portion 310 engages with the lower body garment 200. The lower body garment 200 can also include measurements to describe the location of the engagement device lower portion 310. As shown in FIG. 9, the distance between the top 202 of the lower body garment 200 and engagement device lower portion 310 is shown as measurement "D". Similarly, as shown in FIG. 9, the distance between the bottom of the waistband 204 of the lower body garment 200 and engagement device lower portion 310 is shown as measurement "DW". As will be described in greater detail below, these measurements can be advantageous to the overall functionality of the combined article of apparel 50.

Upper Body Garment 100 Dimensions (FIG. 5A):

"C"—chest circumference of the upper body garment 100

"UEC"—circumference of the upper body garment 100 at the location where the engagement device upper portion 306 circumference engages with the upper body garment 100

"B"—circumference at the bottom of the upper body garment 100

"H"—length of the upper body garment 100

Lower Body Garment 200 Dimensions (FIG. 9):

"LEC"—circumference of the lower body garment 200 at the location where the engagement device lower portion 310 engages with the lower body garment 200

"D"—distance from top of lower body garment 200 to the engagement device lower portion 310

"DW"—distance from bottom of waistband to the engagement device lower portion 310

Engagement Device 300 Dimensions:

"L"—length of engagement device 300

"LU"—length of engagement device upper portion 306

"LL"—the length of engagement device lower portion 310

As described above, certain dimensions of the different portions of the article of apparel 50 can be advantageous to the overall functionality of the article of apparel 50. The upper body garment 100 can be tapered toward the waist area such that the circumference of the upper body garment 100 at the location where the engagement device upper portion 306 engages with the upper body garment 100 "UEC" is less than both the chest circumference "C" and the bottom circumference "B". For example, the ratio of the chest circumference "C" of the upper body garment 100 to the circumference at the location where the engagement device upper portion 306 engages with the upper body garment 100 "UEC" (C:UEC) can be in the range of 1.2:1 to 1.01:1. In other embodiments this ratio (C:UEC) can be about 1.1:1 to 1.01:1, and in still other embodiments this ratio (C:UEC) can be about 1.08 to 1.01:1. Similarly, the ratio of the bottom of the upper garment 100 "B" to the upper body garment 100 circumference at the location where the engagement device upper portion 306 engages with the upper body garment 100 "UEC" (B:UEC) can be in the range of 1.2:1 to 1:1. In other embodiments this ratio (B:UEC) can be about 1.1:1 to 1:1, and in still other embodiments this ratio (B:UEC) can be about 1.07 to 1.01:1.

The upper body garment 100 and the lower body garment 200 can be coordinated to function together. For example, in some embodiments, the circumference of the upper body garment 100 where the engagement device upper portion 306 engages the upper body garment 100 "UEC" is substantially similar to a circumference of the lower body garment 200 where the engagement device lower portion engages the lower body garment 200 "LEC". However, in other embodiments the circumference of the upper body garment 100 where the engagement device upper portion 306 engages the upper body garment 100 "UEC" can be greater or less than the circumference of the lower body garment 200 where the engagement device lower portion engages the lower body garment 200 "LEC". For example, in some embodiments the circumference of the upper body garment 100 where the engagement device upper portion 306 engages the upper body garment 100 "UEC" can be within 10% of the circumference of the lower body garment 200 where the engagement device lower portion engages the lower body garment 200 "LEC".

As described above there are various ratios of different measurements of the upper body garment 100, lower body garment 200, and engagement device 300 that can be advantageous to the overall article of apparel 50. For example, in some embodiments the ratio of the chest circumference "C" to upper engagement circumference "UEC" (C:UEC) can be in the range of in the range of about 1.2:1 to 1.01:1; or about 1.1:1 to 1.01:1; or about or about 1.08 to 1.01:1. Similarly, the ratio of the bottom circumference "B" to upper engagement circumference "UEC" (B:UEC) can be in the range of about 1.2:1 to 1:1; or about 1.1:1 to 1:1; or about 1.07 to 1.01:1.

Similarly, the dimensions of the engagement device 300 including its upper 306 and lower 310 portions and its dimensions relative to the upper body garment 100 and the lower body garment 200 can be important to the functionality of the article of clothing 50. Generally, the engagement device upper portion 306 and the engagement device lower portion 310 will have approximately the same length. However, in some situations it may be advantageous for the engagement device upper portion 306 and the engagement device lower portion 310 to have different lengths. Thus, the ratio of the length of engagement device upper portion 306 "LU" to the length of engagement device lower portion 310 "LL" (LU/LL) can be in the range of about 0.85:1 to 1.15:1; or about 0.90:1 to 1.10:1; or about 0.95:1 to 1.05:1.

Figure 5B:
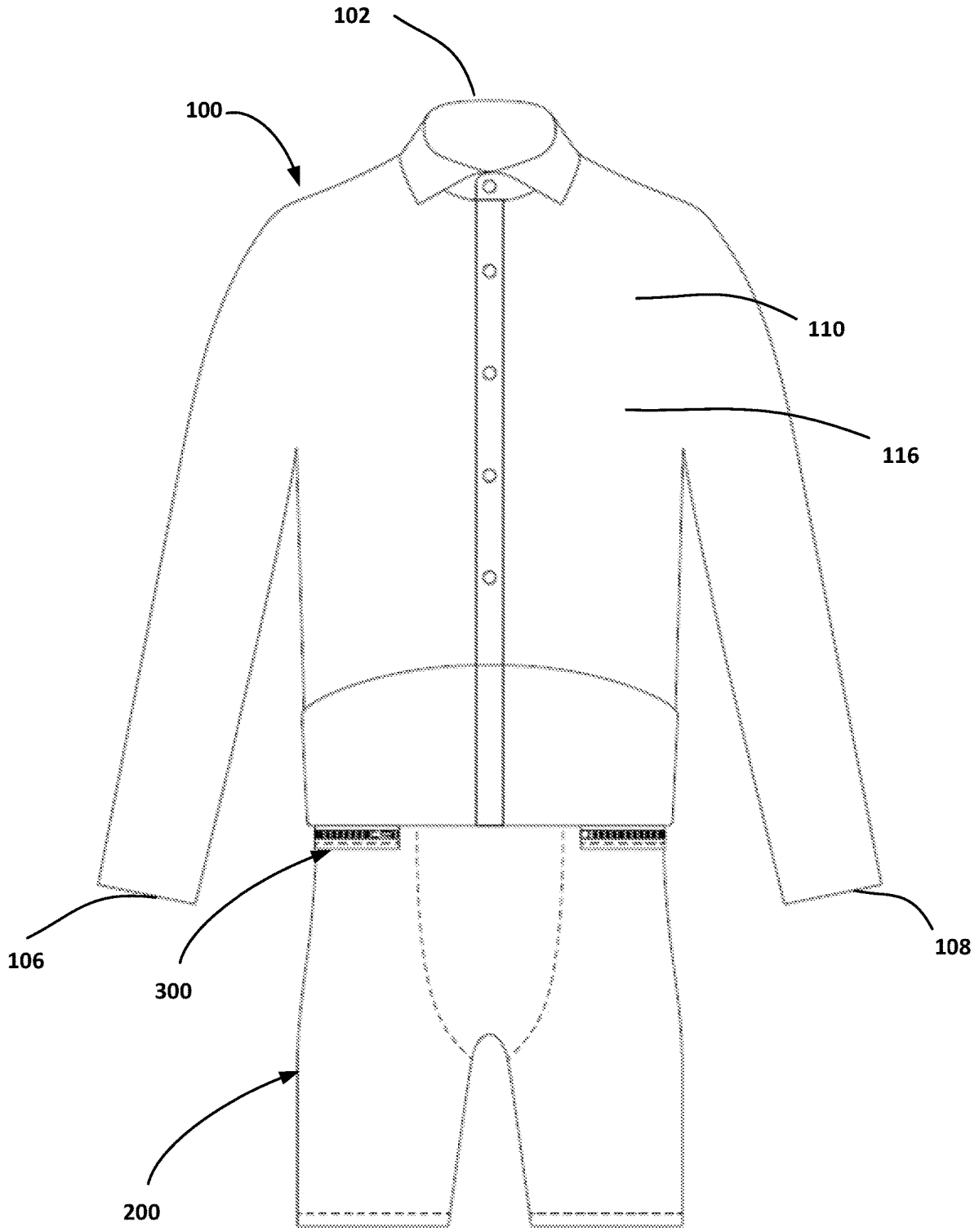
FIG. 5B illustrates a front view of an upper body garment and lower body garment combination shown in the configuration of FIG. 2, according to one or more aspects described herein.
Figure 6A:
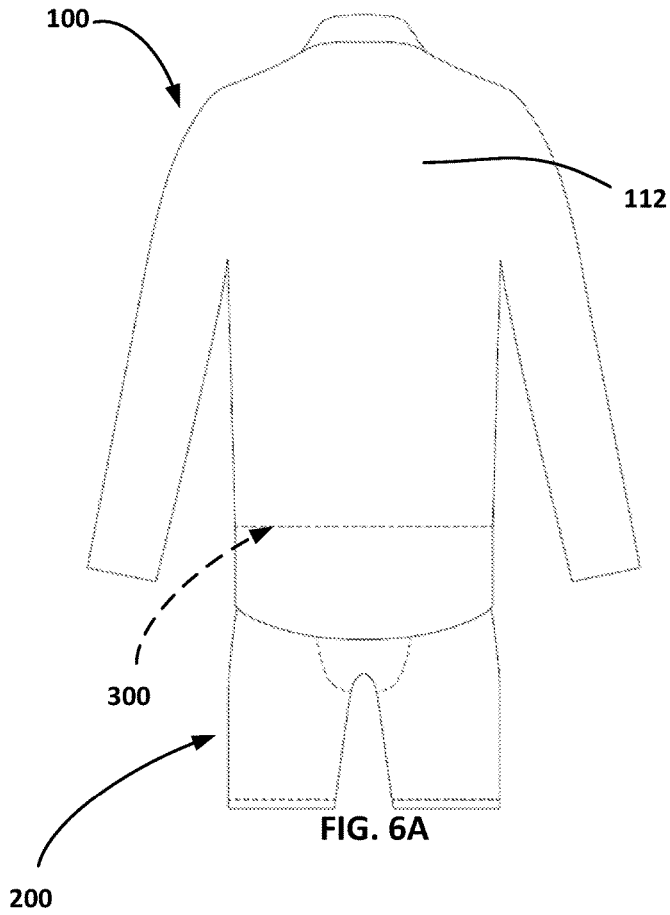
FIG. 6A illustrates a back view of an upper body garment and lower body garment combination of FIG. 1, according to one or more aspects described herein.
Figure 6B:
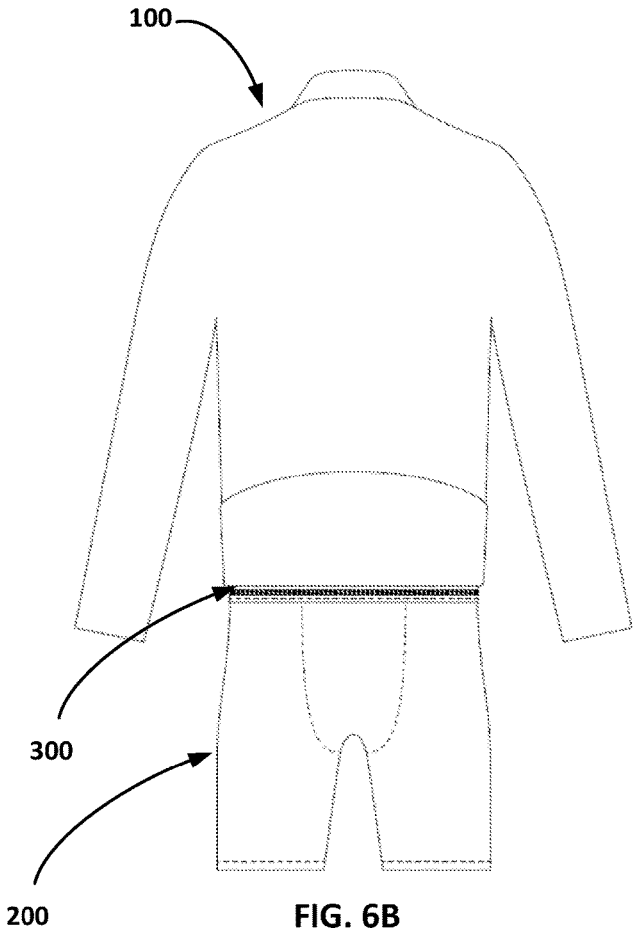
FIG. 6B illustrates a back view of an upper body garment and lower body garment combination shown in the configuration of FIG. 2, according to one or more aspects described herein.
Figure 7A:
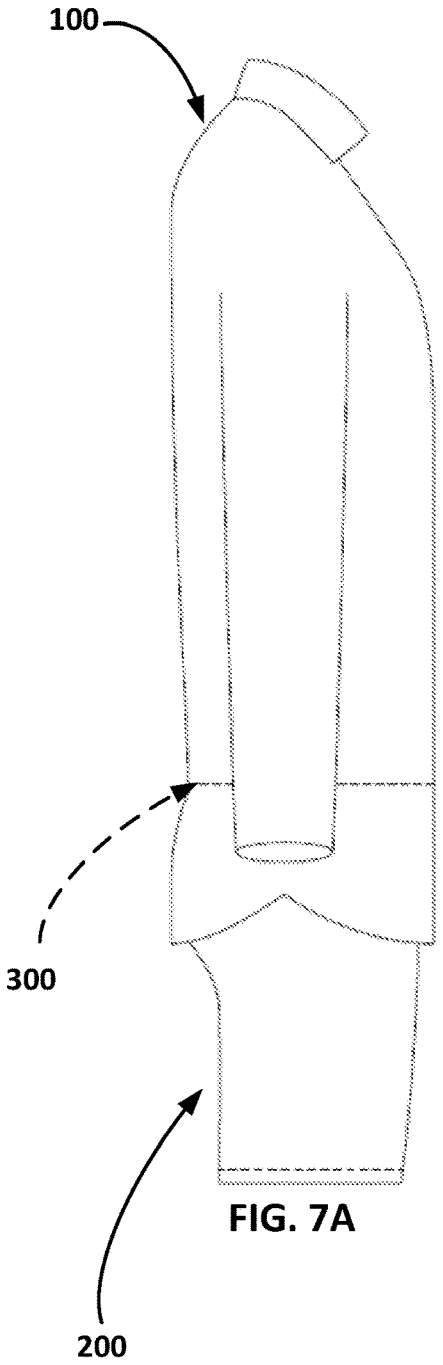
FIG. 7A illustrates a right side view of an upper body garment and lower body garment combination of FIG. 1, according to one or more aspects described herein.
Figure 7B:
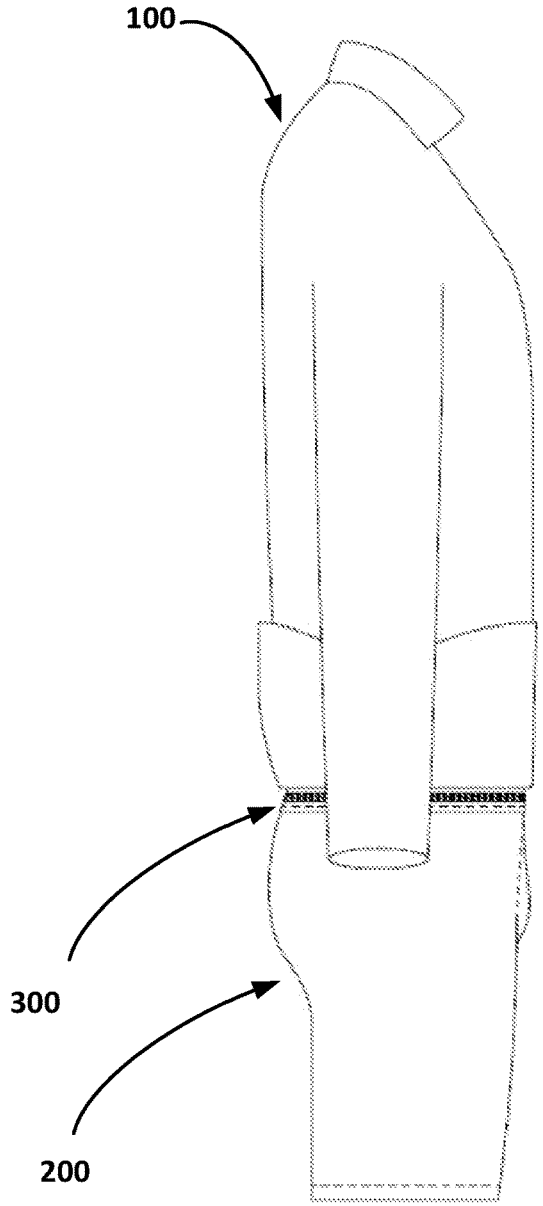
FIG. 7B illustrates a right side view of an upper body garment and lower body garment combination shown in the configuration of FIG. 2, according to one or more aspects described herein.
Figure 8A:
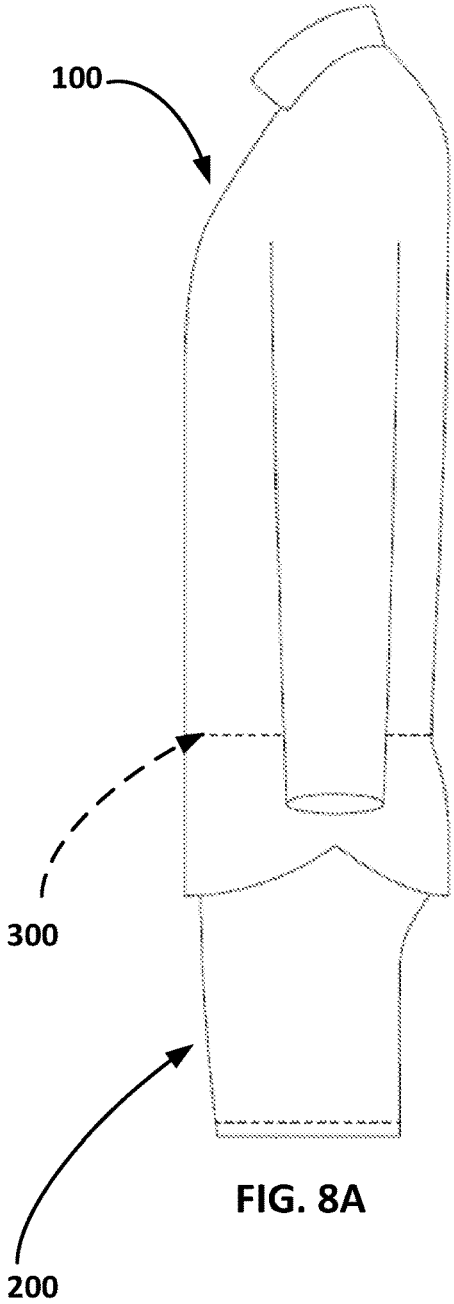
FIG. 8A illustrates a left side view of an upper body garment and lower body garment combination of FIG. 1, according to one or more aspects described herein.
Figure 8B:
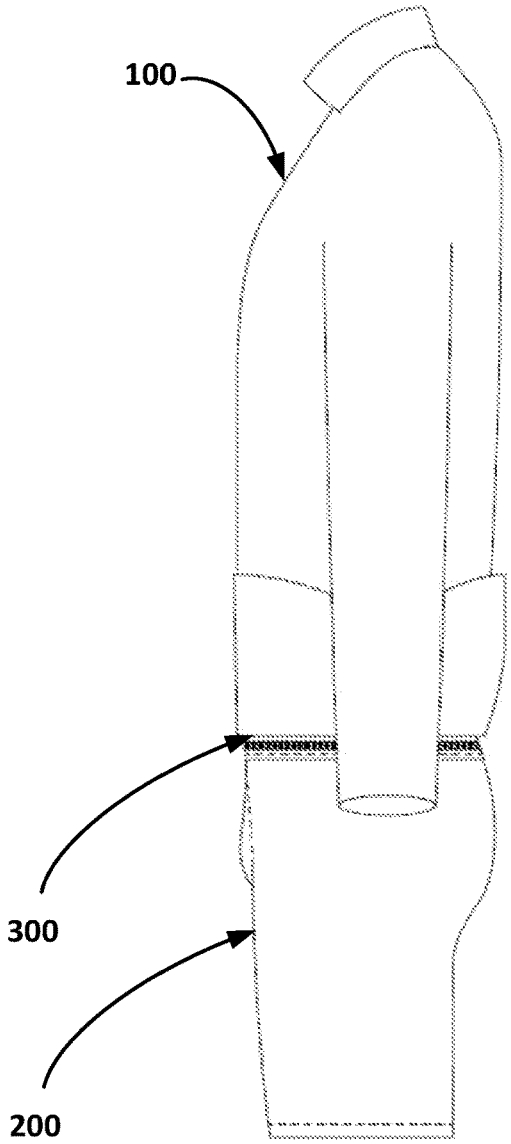
FIG. 8B illustrates a left side view of an upper body garment and lower body garment combination shown in the configuration of FIG. 2, according to one or more aspects described herein

The dimensions of the engagement device 300 including its upper 306 and lower 310 portions to the upper body garment 100 and the lower body garment 200 can be important to the functionality of the article of clothing 50. Importantly the engagement device must be short enough for a user to be able to engage and disengage the engagement device 300 upper 306 and lower 310 portions, but the engagement device 300 must also be long enough to sufficiently engage the upper body garment 100 and the lower body garment 200 together. Thus, in some embodiments, the ratio of the length of engagement device "L" to upper engagement circumference "UEC" (L/UEC) can be in the range of about 0.45:1 to 0.95:1; or about 0.5:1 to 0.90:1; or about 0.70:1 to 0.85:1 Similarly, the ratio of the length of engagement device "L" to lower engagement circumference "LEC" (L/LEC) can be in the range of about 0.45:1 to 0.95:1; or about 0.5:1 to 0.90:1; or about 0.70:1 to 0.85:1. Likewise, the ratio of the length of engagement device upper portion "LU" to the upper engagement circumference "UEC" (LU/UEC) can be in the range of about 0.45:1 to 0.95:1; or about 0.5:1 to 0.90:1; or about 0.70:1 to 0.85:1. And the ratio of the length of engagement device lower portion "LL" to the lower engagement circumference "LEC" (LL/LEC) can be in the range of about 0.45:1 to 0.95:1; or about 0.5:1 to 0.90:1; or about 0.70:1 to 0.85:1. Thus, as shown in FIGS. 3, 5A, and 5B and as described above, the length of the engagement device upper portion is less than the upper engagement circumference. Similarly, as shown in FIGS. 4, 9, and 10 and as described above, the length of the engagement device lower portion is less than the lower engagement circumference. As described above, the engagement device 300 may be a single device, or it may be divided into a plurality of devices. For embodiments that include a plurality of sections of engagement device, the sections can be added to together to obtain the length of the engagement device 300.

The placement of the engagement device lower portion 310 can also be important to the functionality of the article of apparel 50. For example, in some embodiments the engagement device lower portion 310 can be engaged with the lower body garment 310 below the waistband 204. For example, in some embodiments, the distance from top of lower body garment 200 to the engagement device lower portion 310 ("D") in the range of about 1 inch to about 10 inches or in the range of about 2 inches to about 8 inches. Similarly, in some embodiments the distance from bottom of waistband 204 to the engagement device lower portion 310 ("DW") can be in the range of about 0 inches to about 9 inches or in the range of about 1 inch to about 7 inches. However, in other embodiments the engagement device lower portion 310 ("D") can be engaged with the lower body garment 200 at or above the waistband 204.

Table 1 below describes dimensions that may, in some embodiments, be relevant to the overall functionality of article of apparel 50.

TABLE 1

| Relevant Dimensions | |
|---|---|
| Description | Dimension |
| Ratio of the Chest Circumference "C" to upper engagement circumference "UEC" (C:UEC) | In the range of about 1.2:1 to 1.01:1 or about 1.1:1 to 1.01:1 or about 1.08:1 to 1.01:1 |
| Ratio of the Bottom Circumference "B" to upper engagement circumference "UEC" (B:UEC) | In the range of about 1.2:1 to 1:1 or about 1.1:1 to 1:1 or about 1.07:1 to 1.01:1 |
| Ratio of the length of engagement device upper portion "LU" to the length of engagement device lower portion "LL" (LU/LL) | In the range of about 0.85:1 to 1.15:1 or about 0.90:1 to 1.10:1 or about 0.95:1 to 1.05:1 |
| Ratio of the length of engagement device "L" to upper engagement circumference "UEC" (L/UEC) | In the range of about 0.45:1 to 0.95:1 or about 0.5:1 to 0.90:1 or about 0.70:1 to 0.85:1 |

TABLE 1-continued

| Relevant Dimensions | |
|---|---|
| Description | Dimension |
| Ratio of the length of engagement device "L" to lower engagement circumference "LEC" (L/LEC) | In the range of about 0.45:1 to 0.95:1 or about 0.5:1 to 0.90:1 or about 0.70:1 to 0.85:1 |
| Ratio of the length of engagement device upper portion "LU" to the upper engagement circumference "UEC" (LU/UEC) | In the range of about 0.45:1 to 0.95:1 or about 0.5:1 to 0.90:1 or about 0.70:1 to 0.85:1 |
| Ratio of the length of engagement device lower portion "LL" to the lower engagement circumference "LEC" (LL/LEC) | In the range of about 0.45:1 to 0.95:1 or about 0.5:1 to 0.90:1 or about 0.70:1 to 0.85:1 |
| Distance from top of lower body garment 200 to the engagement device lower portion 310 ("D") | In the range of about 1 inch to 10 inches or in the range of about 2 inches to about 8 inches |
| Distance from bottom of waistband to the engagement device lower portion 310 ("DW") | In the range of about 0 inches to 9 inches or in the range of about 1 inch to about 7 inches |

Aspects of the disclosure have been described in terms of illustrative examples thereof. Numerous other examples, modifications, and variations within the scope and spirit of the appended claims will occur to persons of ordinary skill in the art from a review of this disclosure. For example, the article of apparel as described herein may include features that combine features of the article of apparel described herein or some features may be optional in accordance with aspects of the disclosure.

The invention claimed is:

1. An article of apparel, comprising:

an upper body garment comprising a shirt, the upper body garment including a top end, a bottom end, a first arm hole and second arm hole, a front side and a back side, an interior side and an exterior side, the upper body garment also having a chest circumference "C", an upper engagement circumference "UEC", and a bottom circumference "B";

a lower body garment comprising underwear, the lower body garment having a top end including a waistband and a lower end having a first leg hole and a second leg hole, a front side, a back side, an interior side, and an exterior side, the lower body garment also having a lower engagement circumference "LEC", the waistband having a top edge defining a top of the lower body garment and the waistband having a bottom edge;

an engagement device configured to removably engage the upper body garment and the lower body garment such that the upper body garment and the lower body garment can be engaged as a single garment and can be fully separated from each other, the engagement device having a first end and a second end, the engagement device also having an engagement device upper portion engaged with the interior side of the upper body garment at a location on the garment proximate to where the upper engagement circumference "UEC" is measured, the engagement device upper portion having an engagement device upper portion length, and the engagement device having an engagement device lower portion engaged with the exterior side of the lower body garment at a location on the garment proximate to where the lower engagement circumference "LEC" is measured, the engagement device lower portion having an engagement device lower portion length;

wherein the upper body garment is tapered such that the upper engagement circumference "UEC" is less than both the chest circumference "C" and the bottom circumference "B";

wherein the upper engagement circumference "UEC" is substantially similar to the lower engagement circumference "LEC";

wherein the length of the engagement device upper portion is less than the upper engagement circumference;

wherein the ratio of the length of engagement device upper portion "LU" to the upper engagement circumference "UEC" (LU/UEC) is in the range of 0.45:1 to 0.95:1;

wherein the length of the engagement device lower portion is less than the lower engagement circumference;

wherein the ratio of the length of engagement device lower portion "LL" to the lower engagement circumference "LEC" (LL/LEC) is in the range of 0.45:1 to 0.95:1;

wherein the engagement device comprises a continuous zipper;

wherein the engagement device is engaged with the upper body garment and the lower body garment in a substantially vertically level arrangement;

wherein the engagement device lower portion is engaged with the lower body garment in the range of 2 inches to 8 inches below the top of the lower body garment;

wherein the waistband comprises a single continuous band encircling the entire lower body garment;

wherein the engagement device lower portion is located entirely below the waistband; and wherein the distance from the bottom edge of the waistband to the engagement device lower portion is in the range of 1 inch to 7 inches.

2. The article of apparel of claim 1, the engagement device is divided into a plurality of separate sections.

3. The article of apparel of claim 2, the engagement device is divided into two separate sections.

4. The article of apparel of claim 1, wherein the engagement device upper portion is stitched to the upper body garment; and wherein the engagement device lower portion is stitched to the lower body garment.

5. The article of apparel of claim 1, wherein the upper body garment comprises an athletic jersey.

6. The article of apparel of claim 1, wherein the ratio of the length of engagement device upper portion "LU" to the upper engagement circumference "UEC" (LU/UEC) is in the range of 0.70:1 to 0.85:1; and wherein the ratio of the length of engagement device lower portion "LL" to the lower engagement circumference "LEC" (LL/LEC) is in the range of 0.70:1 to 0.85:1.

7. The article of apparel of claim 1, wherein the engagement device upper portion is spaced a distance upward from the upper body garment bottom end such that there is a portion of the upper body garment extending below the waistband and extending below the engagement device and that there is a portion of the lower body garment extending above the engagement device.

8. An article of apparel, comprising:

an upper body garment comprising a shirt, the upper body garment including a top end, a bottom end, a first arm hole and second arm hole, a front side and a back side, an interior side and an exterior side, the upper body garment also having a chest circumference "C", an upper engagement circumference "UEC", and a bottom circumference "B";

a lower body garment comprising underwear, the lower body garment having a top end including a waistband and a lower end having a first leg hole and a second leg hole, a front side, a back side, an interior side, and an exterior side, the lower body garment also having a lower engagement circumference "LEC", the waistband having a top edge defining a top of the lower body garment and the waistband having a bottom edge;

an engagement device configured to removably engage the upper body garment and the lower body garment such that the upper body garment and the lower body garment can be engaged as a single garment and can be fully separated from each other, the engagement device having a first end and a second end, the engagement device also having an engagement device upper portion engaged with the interior side of the upper body garment at a location on the garment proximate to where the upper engagement circumference "UEC" is measured, the engagement device upper portion having an engagement device upper portion length, and the engagement device having an engagement device lower portion engaged with the exterior side of the lower body garment at a location on the garment proximate to where the lower engagement circumference "LEC" is measured, the engagement device lower portion having an engagement device lower portion length;

wherein the upper body garment is tapered such that the upper engagement circumference "UEC" is less than both the chest circumference "C" and the bottom circumference "B";

wherein the length of the engagement device upper portion is less than the upper engagement circumference;

wherein the ratio of the length of engagement device upper portion "LU" to the upper engagement circumference "UEC" (LU/UEC) is in the range of 0.70:1 to 0.85:1;

wherein the length of the engagement device lower portion is less than the lower engagement circumference;

wherein the ratio of the length of engagement device lower portion "LL" to the lower engagement circumference "LEC" (LL/LEC) is in the range of 0.70:1 to 0.85:1; and wherein the engagement device lower portion is engaged with the lower body garment in the range of 2 inches to 8 inches below the top of the lower body garment;

wherein the waistband comprises a single continuous band encircling the entire lower body garment; and wherein the engagement device lower portion is located entirely below the waistband.

9. The article of apparel of claim 8, wherein the ratio of the chest circumference "C" to upper engagement circumference "UEC" (C:UEC) is in the range of 1.2:1 to 1.01:1.

10. The article of apparel of claim 8, wherein the upper engagement circumference "UEC" is equal to the lower engagement circumference "LEC".

11. The article of apparel of claim 8, wherein the upper engagement circumference "UEC" is greater than the lower engagement circumference "LEC".

12. The article of apparel of claim 8, wherein the engagement device upper portion is spaced a distance upward from the upper body garment bottom end such that there is a portion of the upper body garment extending below the waistband and extending below the engagement device and that there is a portion of the lower body garment extending above the engagement device.

13. An article of apparel, comprising:

an upper body garment comprising a shirt, the upper body garment including a top end, a bottom end, a first arm hole and second arm hole, a front side and a back side, an interior side and an exterior side, the upper body garment also having a chest circumference "C", an upper engagement circumference "UEC", and a bottom circumference "B";

a lower body garment comprising underwear, the lower body garment having a top end including a waistband and a lower end having a first leg hole and a second leg hole, a front side, a back side, and interior side, and an exterior side, the lower body garment also having a lower engagement circumference "LEC", the waistband having a top edge defining a top of the lower body garment and the waistband having a bottom edge;

an engagement device configured to removably engage the upper body garment and the lower body garment such that the upper body garment and the lower body garment can be engaged as a single garment and can be fully separated from each other, the engagement device having a first end and a second end, the engagement device also having an engagement device upper portion engaged with the interior side of the upper body garment at a location on the garment proximate to where the upper engagement circumference "UEC" is measured, the engagement device upper portion having an engagement device upper portion length, and the engagement device having an engagement device lower portion engaged with the exterior side of the lower body garment at a location on the garment proximate to where the lower engagement circumference "LEC" is measured, the engagement device lower portion having an engagement device lower portion length;

wherein the length of the engagement device upper portion is less than the upper engagement circumference;

wherein the ratio of the length of engagement device upper portion "LU" to the upper engagement circumference "UEC" (LU/UEC) is in the range of 0.45:1 to 0.95:1;

wherein the length of the engagement device lower portion is less than the lower engagement circumference;

wherein the ratio of the length of engagement device lower portion "LL" to the lower engagement circumference "LEC" (LL/LEC) is in the range of 0.45:1 to 0.95:1;

wherein the engagement device comprises a continuous zipper;

wherein the engagement device is engaged with the upper body garment and the lower body garment in a substantially vertically level arrangement;

wherein the engagement device lower portion is engaged with the lower body garment below the waistband;

wherein the engagement device lower portion is engaged with the lower body garment in the range of 2 inches to 8 inches below the top of the lower body garment;

wherein the waistband comprises a single continuous band encircling the entire lower body garment; and wherein the engagement device lower portion is located entirely below the waistband.

14. The article of apparel of claim 13, the engagement device is divided into a plurality of separate sections.

15. The article of apparel of claim 13, wherein the ratio of the length of engagement device upper portion "LU" to the upper engagement circumference "UEC" (LU/UEC) is in the range of 0.70:1 to 0.85:1; and wherein the ratio of the length of engagement device lower portion "LL" to the lower engagement circumference "LEC" (LL/LEC) is in the range of 0.70:1 to 0.85:1.

16. The article of apparel of claim 13, wherein the ratio of the length of engagement device upper portion "LU" to the upper engagement circumference "UEC" (LU/UEC) is in the range of 0.50:1 to 0.90:1; and wherein the ratio of the length of engagement device lower portion "LL" to the lower engagement circumference "LEC" (LL/LEC) is in the range of 0.50:1 to 0.90:1.

17. The article of apparel of claim 13, wherein the engagement device upper portion is spaced a distance upward from the upper body garment bottom end such that there is a portion of the upper body garment extending below the waistband and extending below the engagement device and that there is a portion of the lower body garment extending above the engagement device.

* * * * *